US005285641A

United States Patent [19]

Goto et al.

[11] Patent Number: 5,285,641

[45] Date of Patent: Feb. 15, 1994

[54] FLOW DIVIDING PUMP

[75] Inventors: Kunifumi Goto; Shigeru Suzuki; Shigeki Kanzaki, all of Kariya, Japan

[73] Assignee: Kabushiki Kaisha Toyoda Jidoshokki Seisakusho, Kariya, Japan

[21] Appl. No.: 788,248

[22] Filed: Nov. 5, 1991

[30] Foreign Application Priority Data

Nov. 10, 1990 [JP] Japan ..... 2-117950[U]

[51] Int. Cl.[5] ..... F16D 31/02

[52] U.S. Cl. ..... 60/422; 60/484; 91/506; 91/444; 91/448; 137/101; 417/270

[58] Field of Search ..... 60/484, 459, 420, 422; 417/270; 91/474, 504, 505, 506, 444, 446, 448, 468; 137/101

[56] References Cited

U.S. PATENT DOCUMENTS

| | | | |
|---|---|---|---|
| 2,452,470 | 10/1948 | Johnson | 137/101 X |
| 2,661,695 | 12/1953 | Ferris | 91/505 X |
| 3,024,798 | 3/1962 | Banker | 137/101 |
| 3,093,079 | 6/1963 | Graham | 91/474 |
| 3,663,126 | 5/1972 | Langosch . | |
| 3,753,627 | 8/1973 | Ward . | |
| 3,916,932 | 11/1975 | Thorson | 137/101 |
| 3,983,893 | 10/1976 | Nubson | 60/422 X |
| 4,070,857 | 1/1978 | Wible | 60/422 |
| 4,240,457 | 12/1980 | Riediger | 137/101 |
| 4,549,466 | 10/1985 | Hoashi et al. . | |
| 4,773,216 | 9/1988 | Ohashi et al. | 91/532 X |

FOREIGN PATENT DOCUMENTS

| | | |
|---|---|---|
| 1097818 | 1/1961 | Fed. Rep. of Germany . |
| 3731261 | 4/1988 | Fed. Rep. of Germany . |
| 61-155677 | 7/1986 | Japan . |

*Primary Examiner*—Edward K. Look
*Assistant Examiner*—Hoang Nguyen
*Attorney, Agent, or Firm*—Brooks Haidt Haffner & Delahunty

[57] ABSTRACT

A compact and light flow dividing pump is disclosed. The pump includes a housing having an end plate attached to one end thereof. The end plate has a fluid suction port and a pair of fluid discharge ports. A pump mechanism is provided in the housing for receiving fluid through the suction port and discharging the received fluid through the discharge ports. A plurality of discharge passages are formed in the end plate between the pump mechanism and the discharge ports. A control valve is also provided in the end plate to control the flow rate of fluid in the discharge passages.

11 Claims, 4 Drawing Sheets

FLOW DIVIDING PUMP

BACKGROUND OF THE INVENTION

1. Field of the Invention

The present invention relates to a flow dividing pump which divides and supplies oil to two separate units.

2. Description of the Related Art

A conventional variable capacity pump is disclosed in Japanese Unexamined Patent Publication No. 61-155677. In order to divide the flow from this type of pump a flow divider unit is attached to the pump. Such flow dividers are conventionally used in industrial vehicles, as for example to divide the hydraulic fluid flow between a power steering device and a loading hydraulic cylinder.

The pump with such a unit has an end plate securely attached to one end of the pump housing. The end plate has a common discharge passage formed therein and is attached with the flow divider unit. The flow divider unit includes an orifice which communicates with the discharge passage and a spool valve (flow divider) which controls the flow rate of oil in cooperation with the orifice. An oil discharge passage and an excess oil discharge passage which communicate with the orifice are provided in the flow divider unit.

The oil discharge passage (hereafter referred to as "control passage") is connected via, for example, a check valve to a power steering device in a forklift truck. The excess oil discharge passage (hereafter referred to as "excess passage") is connected via, for example, a control valve to a hydraulic cylinder in a loading device.

If the flow rate of oil discharged from the pump exceeds a predetermined control flow rate, the difference between the pressures upstream and downstream of the orifice in the flow divider unit becomes large, shifting the spool valve. This shift of the spool valve narrows the opening of the control passage, and forces excess oil to flow into the excess passage so as to maintain the constant flow rate of oil to the power steering device.

When the power steering device is actuated, the spool valve is controlled to open the control passage wider and narrow the opening of the excess passage. On the other hand, when the loading hydraulic cylinder is actuated, the spool valve is adjusted to open the excess passage wider and narrow the opening of the control passage.

Since the flow divider unit is attached to the end plate of the housing of the flow dividing pump described above, the number of necessary components increases, making the whole pump larger and heavier.

Further, the oil passage in this pump must be relatively long in order to feed oil through the end plate to the flow divider unit. This results in an oil pressure loss, which decreases the pumping efficiency. In addition, oil will be heated while passing through the oil passage and become less viscous, which may result in excessive supply of the oil to the downstream side.

For an average forklift truck, the maximum pressure of oil in the power steering device is 85 kgf/cm$^2$, whereas the maximum oil pressure in the loading hydraulic cylinder is 185 kgf/cm$^2$, which is very high. The temperature of oil particularly in the hydraulic cylinder side is likely to rise, and excess oil tends to be supplied to the hydraulic cylinder rather than to the power steering device.

SUMMARY OF THE INVENTION

It is therefore an object of the present invention to provide a flow dividing pump which is compact and light with fewer components, and which can reduce the pressure loss to improve the pumping efficiency. To achieve the object, a flow dividing pump according to the present invention includes a housing having an end plate attached to one end thereof. The end plate has a fluid suction port and a fluid discharge port. A pump mechanism is provided in the housing for receiving fluid through the suction port and discharging the received fluid through the discharge port. A plurality of discharge passages are formed in the end plate between the pump mechanism and the discharge port. A control valve is also provided in the end plate to control the flow rate of fluid in the discharge passages.

In a preferred embodiment, the pump takes the form of a variable displacement swash plate type pump. In another preferred embodiment, the control valve includes a piston that is reciprocatable across the first and second discharge passages. The control valve further includes first and second pressure receiving surfaces that respectively communicate with the first and second discharge passages to reciprocate the piston to control the effective size of openings in the first and second discharge passages.

BRIEF DESCRIPTION OF THE DRAWINGS

The features of the present invention that are believed to be novel are set forth with particularity in the appended claims. The invention, together with objects and advantages thereof, may be best understood by reference to the following description of the presently preferred embodiment together with the accompanying drawings in which:

DETAILED DESCRIPTION OF THE PREFERRED EMBODIMENT

Figure 5:
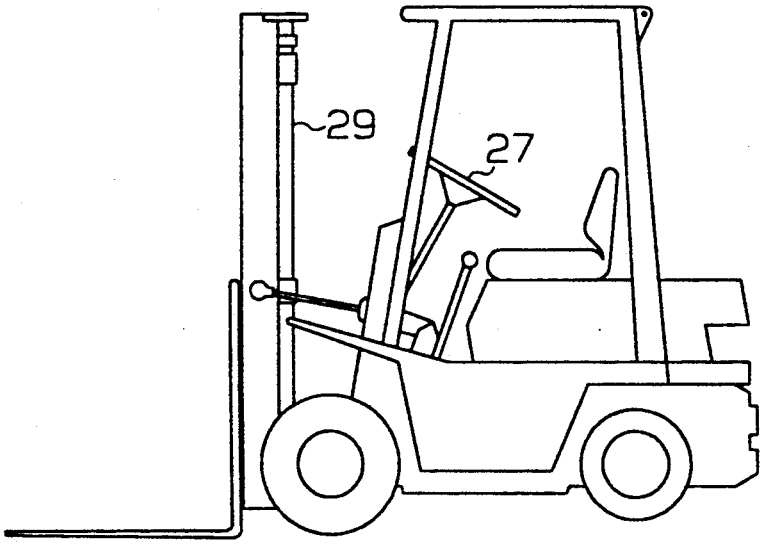
FIG. 5 is a side elevational view of a typical fork lift truck in which the present invention is intended to be used.

A preferred embodiment of the present invention as embodied in a piston type flow dividing pump for use in a forklift truck of the type illustrated in FIG. 5 will now be described referring to the accompanying drawings. To simplify the explanation of the invention, the terms left and right hand sides as applied to the pump are respectively considered the left and right sides shown in FIG. 2.

Figure 2:
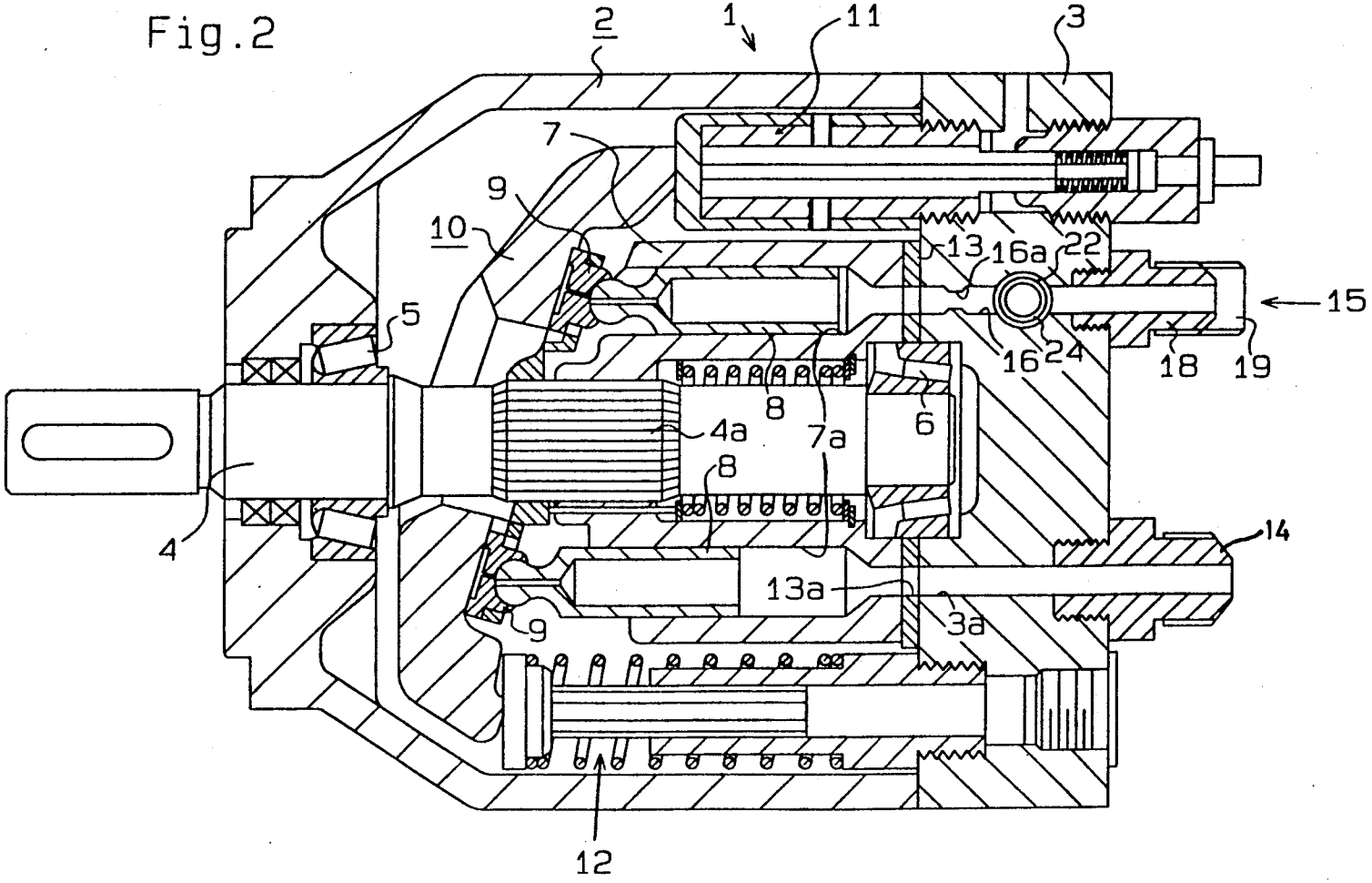
FIG. 2 is a front cross-sectional view illustrating the entire flow dividing pump.

A pump 1 includes a housing 2 as shown in FIG. 2. An end plate 3 is securely connected to the opening of the housing 2 on the right-hand side. A rotary shaft 4 is supported by bearings 5 and 6 in the center of the housing 2 and the end plate 3. A cylinder 7 is fitted on a spline 4*a* of the rotary shaft 4 to be rotatable together with the shaft 4. The cylinder 7 has a plurality of bores 7a formed concentrically about the rotary shaft 4 at equiangular intervals. A piston 8 is accommodated in each bore 7a. A swash plate 10 is supported tiltable in the housing 2, and a shoe 9 is provided on the right side of the swash plate 10. The left end of each piston 8 is coupled to the swash plate 10 by an associated shoe 9.

Figure 4:
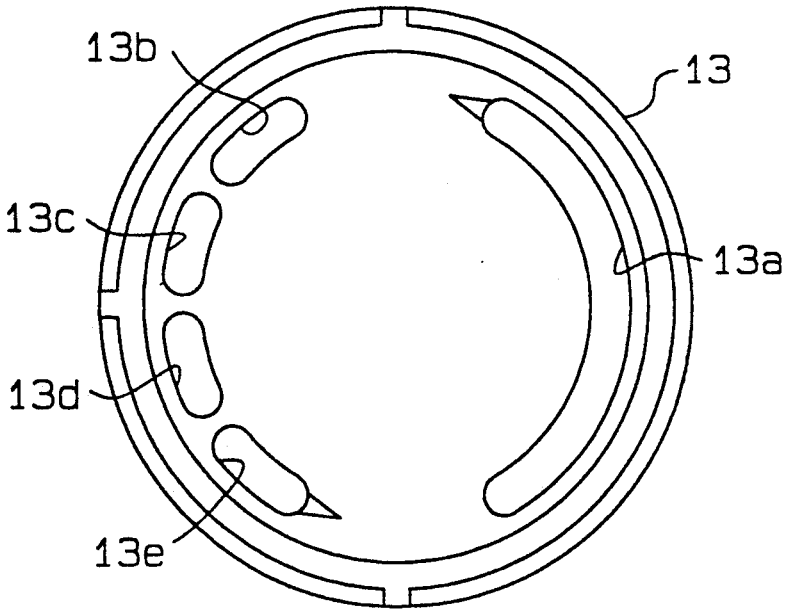
FIG. 4 is a front view of a valve plate in the flow dividing pump.

Stroke adjusting mechanisms 11 and 12 are provided at the end plate 3 in association with the top and bottom ends of the swash plate 10. The stroke adjusting mechanisms 11 and 12 adjust the tilt angle of the swash plate 10 to regulate the position of the swash plate 10. Based on the position of the swash plate 10, the stroke of each piston 8 is controlled to determine the amount of oil that the pump discharges. A valve plate 13 is fixed between the end plate 3 and the cylinder 7. The cylinder 7 rotates while contacting the valve plate 13. The valve plate 13 has a suction hole 13a and four divided discharge holes 13b to 13e as shown in FIG. 4. The holes 13a to 13e are positioned at equal intervals about and equidistant from the rotary shaft 4.

A suction passage 3a which corresponds to the suction hole 13a of the valve plate 13 is formed in the end plate 3. A suction port 14 is securely screwed into the end plate 3. The suction port 14 communicates with the suction passage 3a and is connected to an oil tank T (not shown in FIG. 1). A flow divider 15 is incorporated in the end plate 3 to divide oil discharged from the discharge holes 13b to 13e of the valve plate 13.

As the rotary shaft 4 and the cylinder 7 rotate together, the distance that the pistons 8 travel during each reciprocating stroke varies in accordance with the tilt angle of the swash plate 10. While the pistons 8 are moved from the top dead point to the bottom dead point, oil is sucked into the bores 7a. During the movement of the pistons 8 from the bottom dead point to the top dead point, the oil in the bores 7a is forced out to the discharge holes 13b to 13e to be supplied to the flow divider 15.

Figure 1:
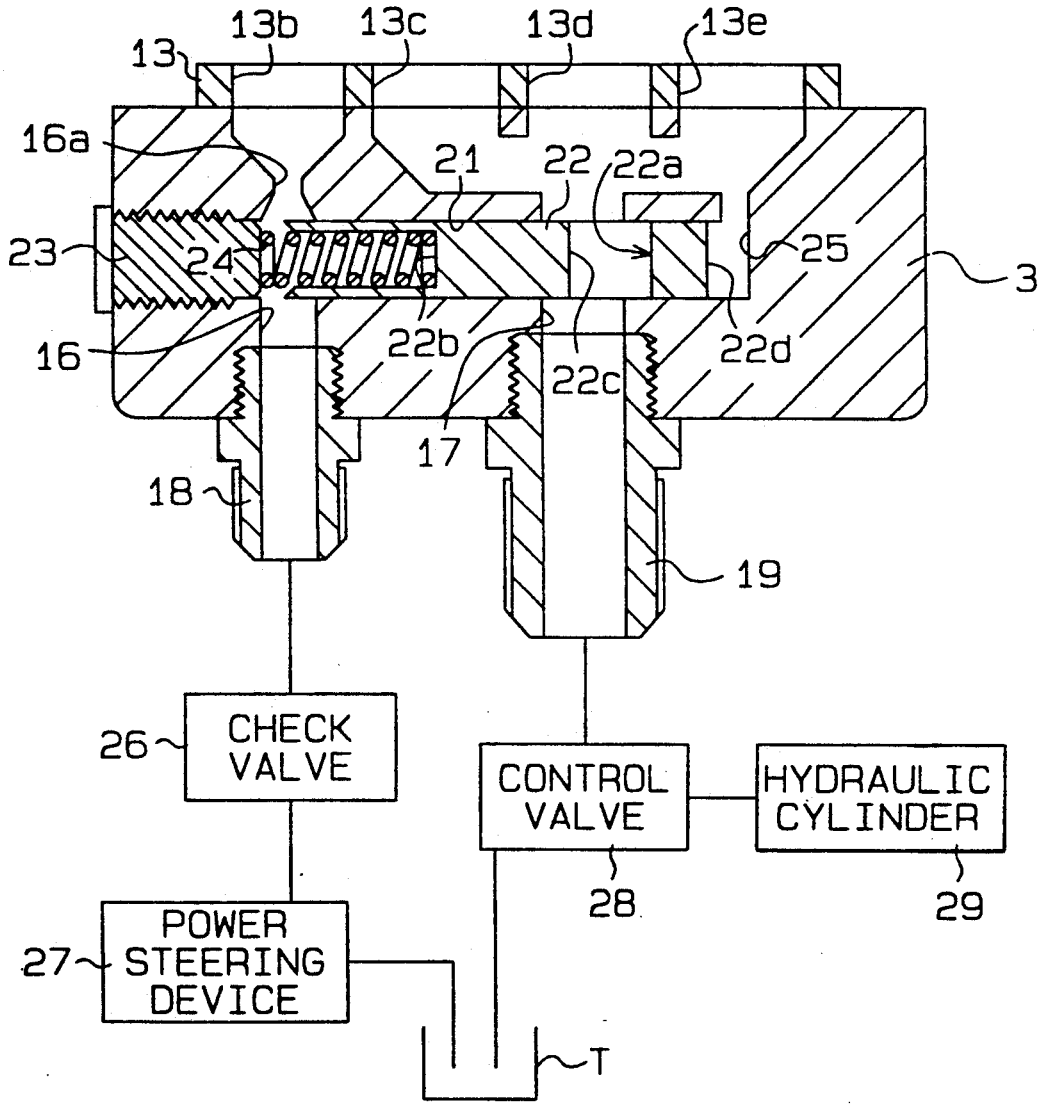
FIG. 1 is a partly cross-sectional plan view of one embodiment according to the present invention as embodied in a piston type flow dividing pump.

The flow divider 15 will now be explained in detail referring to FIG. 1. An oil discharge passage (control passage) 16 which communicates with the discharge hole 13b is formed in the end plate 3. The control passage 16 has a constriction 16a. The end plate 3 also has an excess oil discharge passage (excess passage) 17 formed therein which communicates with the discharge holes 13c to 13e. First and second discharge ports 18 and 19 are connected respectively to the control passage 16 and the excess passage 17. Further, a valve accommodating hole 21 is formed across the control passage 16 and the excess passage 17 in the end plate 3. The end plate 3 also includes a pressure chamber 25 which communicates with the discharge holes 13b to 13e. A spool valve (control valve) 22 is slidably mounted in the valve accommodating hole 21. A through hole 22a is formed in the spool valve 22 to constrict the opening of the excess passage 17. The spool valve 22 also has right and left pressure receiving surfaces 22d and 22b. The right pressure receiving surface 22d receives the oil pressure in the pressure chamber 25, while the left pressure receiving surface 22b receives the oil pressure in the control passage 16. A spring retainer 23 is screwed into the end plate 3, and a spring 24 is located between the spring retainer 23 and the left pressure receiving surface 22b of the spool valve 22. The spring 24 pushes the spool valve 22 rightward in FIG. 1. When the spool valve 22 moves to the right, the control passage 16 will open wider and the excess passage 17 will be constricted by the through hole 22a. When the spool valve 22 moves to the left, the control passage 16 will reduce its opening and the excess passage 17 will open wider.

The first discharge port 18 is connected through a check valve 26 to a power steering device 27. The second discharge port 19 is connected to a control valve 28, which is connected to a loading hydraulic cylinder 29. The oil which is supplied to the power steering device 27 and the control valve 28 will return to the tank T.

Figure 3:
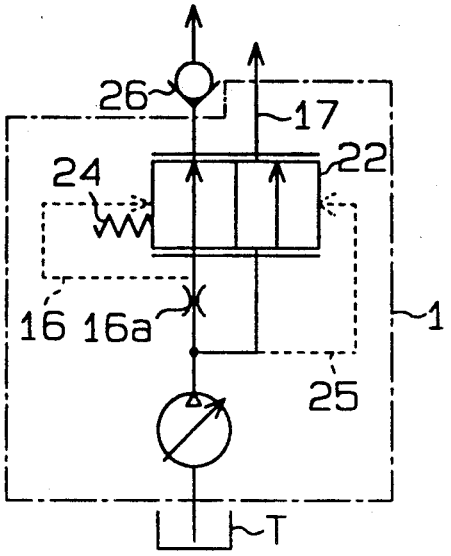
FIG. 3 is a hydraulic circuit diagram of the flow dividing pump.

FIG. 3 illustrates an equivalent circuit of the flow dividing pump with the above structure.

The action of the flow dividing pump will now be described. When the rotary shaft 4 is rotated to reciprocate the pistons 8 in the pump 1, oil is sucked into the bores 7a from the tank T through the suction port 14 and suction hole 13a, and then is discharged from the discharge holes 13b to 13e. The oil discharged from the discharge hole 13b is supplied through the control passage 16, the first discharge port 18 and the check valve 26 to the power steering device 27. The oil from the discharge holes 13c to 13e is supplied through the excess passage 17 and the second discharge port 19 to the control valve 28.

In this running status of the flow dividing pump, the spool valve 22 receives the resultant force of the oil pressure P16 in the control passage 16 acting on the left pressure receiving surface 22b and spring force F24 of the spring 24. This resultant force biases the spool valve 22 to the right as seen in FIG. 1. Pressure P25 from the pressure chamber 25 acts on the right pressure receiving surface 22d of the spool valve 22 to bias the spool valve 22 to the left as seen in FIG. 1. The spool valve 22 is therefore maintained stationary at the position where the forces from both right and left are equally balanced.

Under the above conditions, if the stroke adjusting mechanism 11 operates to alter the top dead points of the pistons 8 so as to increase the discharge capacity of the pump, the pressure P16 acting on the spool valve 22 of the control passage 16 will rise accordingly. Since the increase in the pressure P16 is controlled by the constriction 16a, however, the pressure P16 will not rise as much as the pressure P25 in the excess passage 17. The spool valve 22 is therefore moved to the left as seen in FIG. 1. As a result, the flow rate of oil in the excess passage 17 increases and the flow rate in the control passage 16 remains more or less constant.

When the power steering device 27 is activated, the amount of oil it requires increases. The flow rate of oil in the control passage 16 rises accordingly, thus increasing the pressure P16 acting on the pressure receiving surface 22b of the spool valve 22. The spool valve 22 is thus shifted to the right in FIG. 1. The flow rate of oil for the power steering device 27 therefore increases more, while the amount of oil supplied to the excess passage 17 decreases.

When the loading cylinder 29 is driven, the required amount of oil in the cylinder 29 increases. The flow rate of oil in the excess passage 17 increases as a consequence, and the pressure on the pressure receiving surface 22d of the spool valve 22 rises accordingly. The spool valve 22 is therefore forced to move to the left as seen in FIG. 1. As a result, the flow rate of oil in the excess passage 17 becomes even greater, to properly supply oil to the loading hydraulic cylinder 29. Thus, the amount of oil in the control passage 16 drops.

In the above-described embodiment, not only the control passage 16 and the excess passage 17 but also the spool valve 22 for controlling the flow rate of oil in the passages 16 and 17 are formed in the end plate 3. The pump of the present invention can be made more compact and lighter with fewer components when compared to a conventional pump having a flow dividing unit attached to one end of the end plate.

Further, after the oil passes through the discharge holes 13*b* to 13*e* of the valve plate 13, the pump can immediately divide the oil inside the end plate 3. Compared to a conventional structure with a common discharge passage formed in the end plate 3, therefore, it is possible to reduce the pressure loss of the oil as well to prevent the rise in the temperature of the oil while improving the pumping efficiency.

The present invention is not limited to this embodiment directed to a piston type pump, but it may also be applied to a flow dividing pump of a vane type or gear type.

What is claimed is:

1. A flow dividing pump comprising:

a housing having an opening at an end;

an end plate attached to said opening of the housing, said end plate having a fluid suction port and a pair of fluid discharge ports;

a pump mechanism incorporated in said housing for receiving fluid through said suction port and discharging the received fluid through said discharge ports, said pump mechanism comprising a cylinder rotatably supported by said housing and said end plate, a plurality of bores formed in said cylinder, respective pistons slidably mounted in said bores for reciprocal motion therein, a swash plate coupled to a first end of each piston, said swash plate being pivotally mounted to permit altering the capacity of said pump by pivoting said swash plate, and means for rotating said swash plate to reciprocate said pistons;

a plurality of discharge passages formed in said end plate between said pump mechanism and said discharge ports;

a control valve provided in said end plate for controlling the flow rate of fluid in said discharge passages;

a valve plate provided between said cylinder and said end plate, said valve plate having an enlarged suction hole that simultaneously communicates with a plurality of said bores, and a plurality of discharge holes;

said discharge passages being disposed in association with said discharge holes of said valve plate with a first of said discharge passages communicating with a first of said discharge holes, and a second of said discharge passages communicating with the rest of said discharge holes;

whereby as said cylinder rotates, the pistons are reciprocated according to the position of the swash plate so as to pump fluid from the suction port to the discharge ports.

2. A flow dividing pump according to claim 1, wherein said control valve is disposed for reciprocation across said first and second discharge passages, and has first and second pressure receiving surfaces that respectively communicate with said first and second discharge passages, said control valve being arranged to reciprocate to control the effective openings in said first and second discharge passages.

3. A flow dividing pump according to claim 2, wherein said control valve is urged by a spring in the direction to reduce the opening of said second discharge passage and enlarge the opening of said first discharge passage.

4. A flow dividing pump according to claim 1, further comprising a pressure chamber formed in said second discharge passage for enabling fluid pressure to be applied to said control valve in a first direction, and a spring disposed for urging said control valve in the opposite direction to said first direction.

5. A flow dividing pump according to claim 1, wherein said first discharge passage is connected to a power steering device in a forklift truck and said second discharge passage is connected to a loading cylinder of said forklift truck.

6. A flow dividing pump according to claim 1, wherein said swash plate alters the capacity of said pump to supply the required amount of oil to said second passage.

7. A flow dividing pump according to claim 1, wherein said control valve comprises a valve spool disposed for reciprocation within a valve chamber intersecting said first and second discharge passages, said first discharge passage being provided with a constriction located between said valve chamber and said valve plate, said valve spool upon reciprocation controlling reciprocally the cross sectional area of said first and second discharge passages, and a spring biasing said valve spool in the direction tending to open said first discharge passage and close said second discharge passage.

8. A flow dividing pump comprising:

a housing having an opening at an end;

an end plate, attached to said opening of the housing and having a fluid suction port and a pair of fluid discharge ports;

a cylinder rotatably supported by said housing and said end plate;

a plurality of bores formed in said cylinder;

a plurality of pistons, each piston being slidably mounted in an associated one of said bores for reciprocatable movement in said associated bore; and a swash plate coupled to a first end of each piston, said swash plate being pivotally mounted to permit altering the capacity of said pump by pivoting said swash plate, whereby as said cylinder rotates, the pistons are reciprocated according to the position of the swash plate so as to pump fluid from the suction port to the discharge ports;

a valve plate provided between said cylinder and said end plate, said valve plate having an enlarged suction hole that simultaneously communicates with a plurality of said bores, and a plurality of discharge holes;

a plurality of discharge passages formed in said end plate, said discharge passages being disposed in association with said discharge holes of said valve plate with a first of said discharge passages communicating with a first of said discharge holes, and a second of said discharge passages communicating with the rest of said discharge holes; and a control valve disposed for reciprocation across said first and second discharge passages, said control valve having first and second pressure receiving surfaces that respectively communicate with said first and second discharge passages, said control valve being arranged to reciprocate to control the effective size of openings in said first and second discharge passages.

9. A flow dividing pump according to claim 8, wherein a spring is provided for urging said control valve in a direction to reduce said opening of said second discharge passage and enlarge said opening of said first discharge passage.

10. A flow dividing pump according to claim 8, further comprising a pressure chamber formed in said second discharge passage for enabling fluid pressure to be applied to said control valve in a first direction and a spring disposed for urging said control valve in the opposite direction to said first direction.

11. A flow dividing pump according to claim 8, wherein said first discharge passage is connected to a power steering device in a forklift truck and said second discharge passage is connected to a loading cylinder of said forklift truck.

* * * * *